US005101761A

United States Patent [19]

Isowa et al.

[11] Patent Number: 5,101,761

[45] Date of Patent: Apr. 7, 1992

[54] LIQUID TRANSFERRING UNIT

[75] Inventors: Eiichi Isowa, Nagoya; Toshihiko Yasui, Owariasahi; Mitsuhiro Ishizuka, Urawa, all of Japan

[73] Assignee: Isowa Industry Company Ltd., Nagoya, Japan

[21] Appl. No.: 521,946

[22] Filed: May 11, 1990

[30] Foreign Application Priority Data

May 27, 1989 [JP] Japan ..... 1-133300

[51] Int. Cl.[5] ..... B05C 1/08

[52] U.S. Cl. ..... 118/663; 118/249; 118/262

[58] Field of Search ..... 118/249, 258, 262, 261, 118/663

[56] References Cited

U.S. PATENT DOCUMENTS 1,558,271 10/1925 Newell ..... 118/249
2,156,901 5/1939 Brady ..... 118/262
3,936,549 2/1976 Kohler et al. ..... 118/262

FOREIGN PATENT DOCUMENTS 1233958 5/1986 U.S.S.R. ..... 118/249

*Primary Examiner*—Michael G. Wityshyn
*Attorney, Agent, or Firm*—Schwartz & Weinrieb

[57] ABSTRACT

Disclosed is a liquid transferring unit having a tank carrying a liquid such as, for example, a glue or an ink, an applicator roll with a part thereof being immersed within the liquid disposed within in the tank, a doctor roll which scrapes off or removes the surplus liquid taken up by means of the applicator roll, and a pair of dam plates which are disposed within the tank so as to be movable toward and away from each other along a direction parallel to the axis of the applicator roll; characterized in that the pair of dam plates have regulating sections, respectively, which can be abutted against the opposing circumferential portions of the two rolls, so that the triangular space defined between the two rolls may be closed by means of such regulating sections.

8 Claims, 6 Drawing Sheets

LIQUID TRANSFERRING UNIT

FIELD OF THE INVENTION

This invention relates to a liquid transferring unit in which surplus liquid taken up by means of an applicator is designed to be scraped away or removed by means of a doctor roll, and more particularly to a liquid transferring unit having a means which can effectively prevent the liquid scraped away or removed by means of the doctor roll from spreading along the axial extent of the applicator roll.

BACKGROUND OF THE INVENTION

There has been known a single facer which forms a single-faced corrugated board by providing a corrugating medium with a corrugation having a predetermined pitch size, and providing the medium with a liner upon the crests of the corrugations using a suitable adhesive. In such a single facer, a gluing unit for applying a glue to the corrugating medium is indispensable. The gluing unit is basically composed of an applicator roll, a doctor roll and a glue pan.

In the above gluing unit, the glue disposed within the glue pan is taken up by means of the applicator roll and the glue disposed upon the applicator roll surface is leveled by means of the doctor roll so as to form a uniform glue layer. The glue is then applied to the crests of the corrugated medium, having a predetermined type of flute formed by means of predetermined fluted rolls, through means of the applicator roll. The thus glued corrugated medium is bonded by means of a predetermined amount of pressure with a liner so as to form a single-faced corrugated board.

In the gluing unit, if the zone of the glue disposed upon the applicator roll has a width wider than the width of the corrugated medium during transfer of the glue from the applicator roll to the corrugated medium, the glue disposed upon the applicator roll is undesirably transferred to the fluted rolls. In order to prevent such undesired glue transference to the fluted rolls, the gluing unit is designed to have a pair of dam plates (generally referred to as "glue dams") disposed within the glue pan so as to be movable toward and away from each other along the axis of the applicator roll so as to allow the glue confined between the glue dams to be taken up by means of the applicator roll. Accordingly, by adjusting the axial distance defined between the glue dams depending upon the width of the corrugated medium, the glue is permitted to be deposited upon the applicator roll only within a zone or region having a width corresponding to the width of the corrugated medium.

In this context, while corrugators are designed to be operated at a high rate of speed in order to improve productivity of corrugated board sheets in the corrugator industry, the following problem has arisen with respect to the speed of the production line. To describe the problem in detail, with the high-speed operation of the single facer, the applicator roll also undergoes high-speed rotation, whereby the amount of glue to be taken up by means of the roll is increased. The surplus glue scraped off or removed from the applicator roll by means of the doctor roll does not drop back toward the glue pan but stays within the vicinity of the zone where the two rolls are brought into contact with each other, as a result of the high-speed rotation of the applicator roll, and consequently the surplus glue overruns the glue dams and spreads outwardly along the axis of the applicator roll. Consequently, the glue is spread upon the applicator roll over an area which is wider than the width of the corrugated medium, and thus, the fluted rolls are contaminated by means of the overflowing glue portions transferred thereto.

OBJECT OF THE INVENTION

This invention is proposed in view of the above problem inherent in the liquid transferring unit and to solve it in a suitable manner and is directed toward providing a simple means for preventing the liquid from spreading along the axis of the applicator roll which occurs during the high-speed rotation of the applicator roll.

SUMMARY OF THE INVENTION

In order to solve the above problem and successfully attain the intended object, this invention provides a liquid transferring unit comprising a tank carrying a liquid such as, for example, a glue and an ink, an applicator roll with a part thereof being immersed within the liquid disposed within the tank, a doctor roll which scrapes off the surplus liquid taken up by means of the applicator roll, and a pair of dam plates which are disposed within the tank so as to be movable toward and away from each other along the axis of the applicator roll, characterized in that the pair of dam plates have regulating sections, respectively, which can be abutted against the opposing circumferences of the two rolls, so that the triangular space defined between the two rolls may be closed by means of the regulating sections.

As described above, according to the liquid transferring unit of this invention, the triangular space defined between the two rolls (that is, the space adjacent to the contact zone of the two rolls) is designed to be closed by means of a pair of regulating plates, whereby the surplus liquid scraped off or removed from the applicator roll by means of the doctor roll can effectively be prevented from spreading along the axis of the applicator roll. In other words, the liquid is allowed to be deposited only onto the predetermined zone of the applicator so as to constantly carry out transference of the liquid to the corrugated medium. It is noted that the axes of the rolls 18, 20, and 12 are disposed along a plane which is inclined with respect to a vertical plane, while the axes of rolls 24, 26, and 12 are disposed along a vertical plane. Moreover, the simple structure can advantageously achieve cost reduction in the liquid transferring unit.

PREFERRED EMBODIMENTS OF THE INVENTION

Next, the liquid transferring unit of this invention will be described by way of preferred embodiments and by referring to the attached drawings. It should be noted, however, that while the liquid transferring unit of this invention is described with respect to the gluing units for the single facer which forms single-faced corrugated boards in the illustrated embodiments, it is of course possible to use the present liquid transferring unit as a gluing unit in the double facer which forms double-faced corrugated boards or as an ink transferring mechanism in a printing apparatus, or the like.

Figure 6:
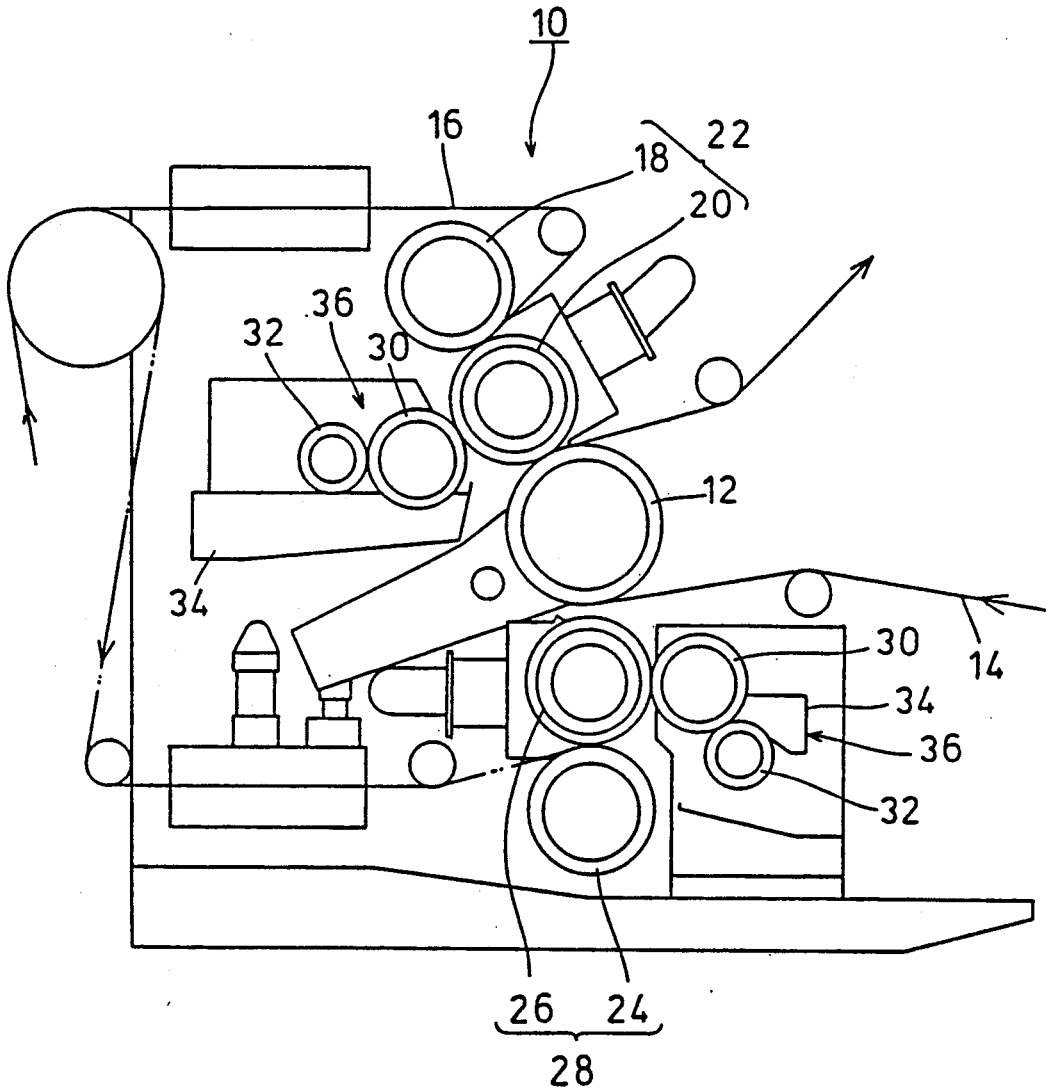
FIG. 6 is a schematic constitution of a single facer in which the gluing unit according to any of the above preferred embodiments can suitably be employed.

FIG. 6 shows schematically the constitution of a single facer 10 in which the gluing units according to the preferred embodiments of the present invention can be suitably employed; wherein the reference number 12 shows a press roll for guiding a liner 14 and bonding it to the glued crests of a corrugated medium 16. Disposed above the press roll 12 is a first fluted roll unit 22 comprising a pair of fluted rolls, that is, an outer fluted roll 18 and an inner fluted roll 20; whereas below the press roll 12 there is disposed a second fluted roll unit 28 also comprising a pair of fluted rolls, that is, an outer roll 24 and an inner fluted roll 26. It is noted that the axes of the rolls 18, 20, and 12 are disposed along a plane which is inclined with respect to a vertical plane, while the axes of rolls 24, 26, and 12 are disposed along a vertical plane. When the single facer is operated, either the combination of the first fluted roll unit 22 with the press roll 12 or the combination of the second fluted roll unit 28 and the press roll 12 can be selected for corrugation of a medium such as that shown at 16.

In each of the first fluted roll unit 22 and the second fluted roll unit 28, there is disposed a gluing unit 36 comprising an applicator roll 30, a doctor roll 32 and a glue pan 34. It should be noted here that the distinction between the outer fluted roll and the inner fluted roll is not made based upon the spatial relationship defined therebetween but is made relative to the press roll 12. Namely, it should be appreciated that those fluted rolls which are brought into press contact with the press roll 12 through means of the liner 14 and the corrugated medium 16 are referred to as "inner fluted rolls".

Figure 1:
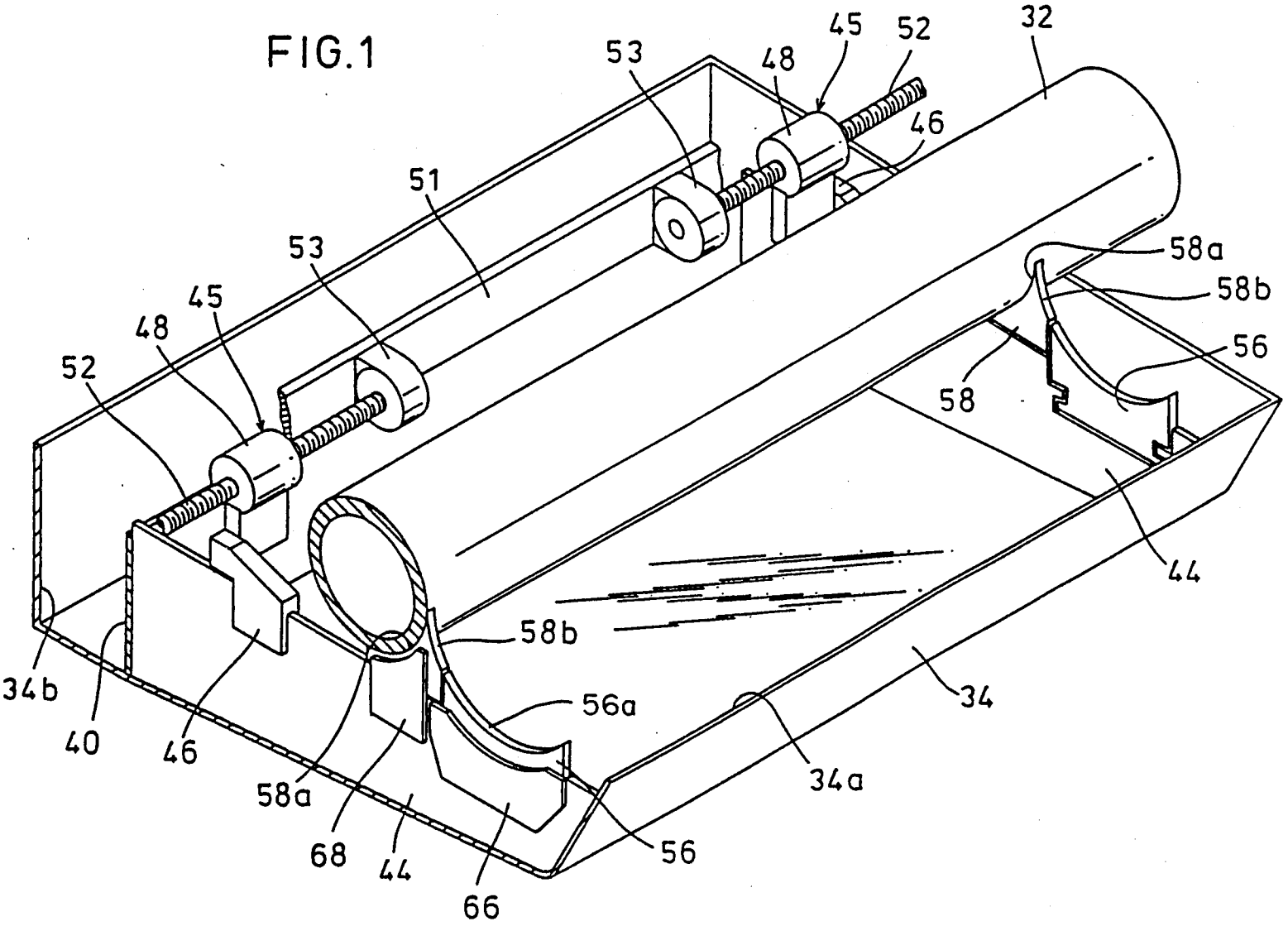
FIG. 1 is a perspective view of the gluing unit according to a preferred embodiment of this invention.
Figure 2:
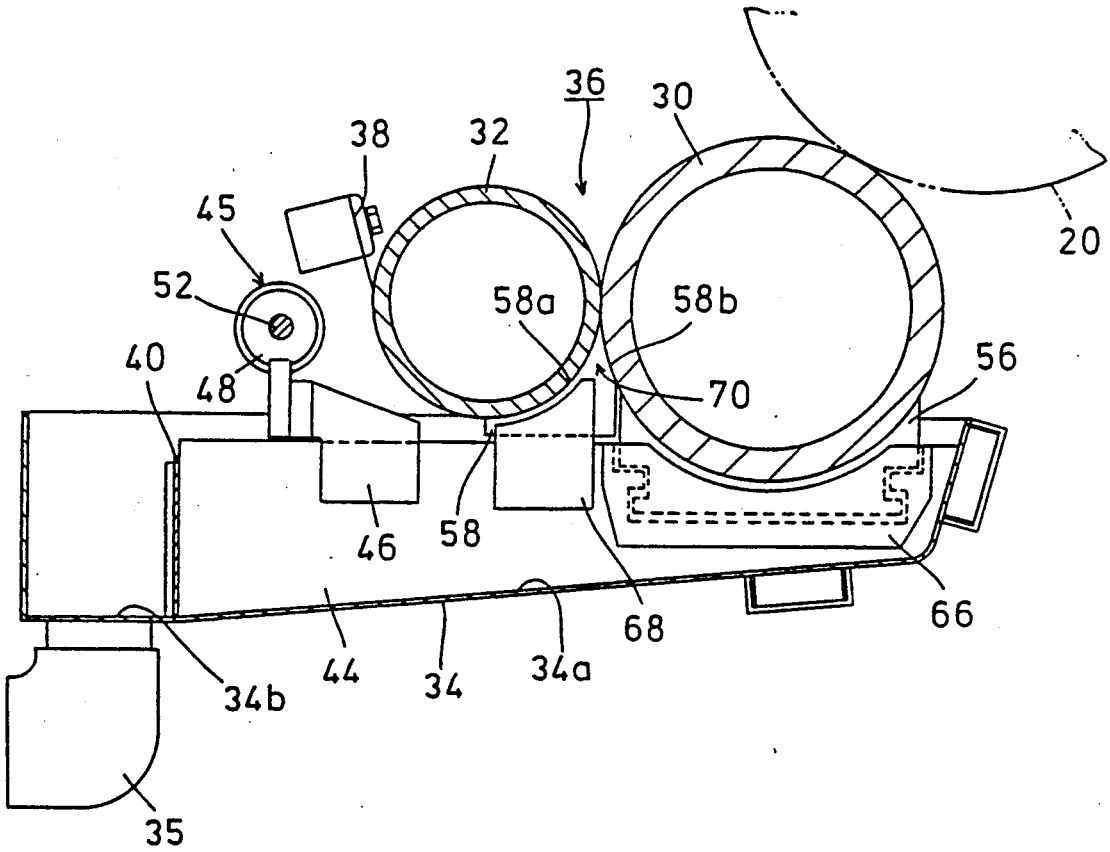
FIG. 2 is a cross-sectional side view of the gluing unit shown in FIG. 1.

The gluing unit 36 disposed within the first fluted roll unit 22 basically comprises, as shown in FIG. 2, an applicator roll 30 disposed parallel to the inner fluted roll 20 in such a way that it can be abutted against the inner fluted roll 20 through means of the corrugated medium 16; a glue pan 34 disposed below the applicator roll 30 and carrying a predetermined amount of glue; and a doctor roll 32 which is disposed in contact with the applicator roll 30 along the entire axial length thereof (actually with a very small clearance) for scraping off the surplus glue remaining upon the applicator roll 30. Incidentally, the reference number 38 designates a scraper for removing the glue deposited onto the doctor roll 32.

Figure 3:
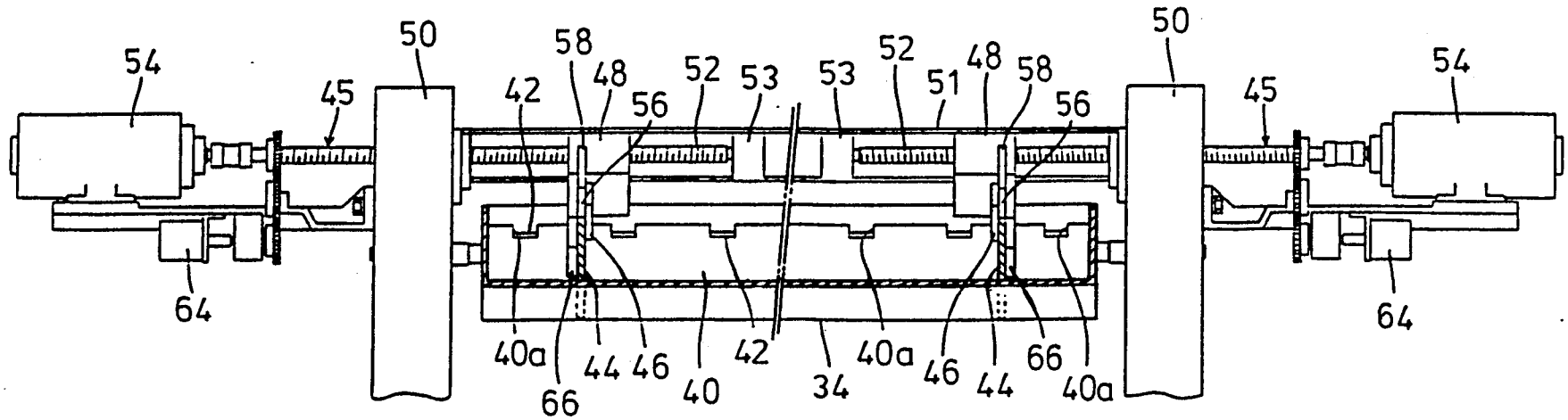
FIG. 3 is a cross-sectional front view of the gluing unit shown in FIG. 2 from which the applicator roll and the doctor roll are removed.

In the glue pan 34, a weir 40 having a predetermined height is disposed along the entire width thereof (along the axial length of the applicator roll 30) so as to divide the glue pan 34 into a gluing section **34*a* and a collecting section 34*b*. Along the upper edge of the weir 40, a plurality of rectangular notches 40*a* are formed with predetermined intervals defined therebetween as shown in FIG. 3, which allow the surplus glue to overflow into the collecting section 34*b* when more than a predetermined amount of glue is fed to the gluing section 34*a*. The glue overflowing into the collecting section 34*b* is fed back to a glue tank (not shown) through means a glue collecting pipe 35 connected to the glue pan 34 for recirculation of the excess glue. Incidentally, the weir 40 has a sliding panel 42 which can adjust the aperture size of each notch 40*a*, whereby the amount of the glue to overflow from the gluing section 34*a* into the collecting section 34*b*** can be adjusted.

In the gluing section **34*a* of the glue pan 34, a pair of glue dams 44 are disposed along the width of the glue pan 34 with a predetermined space therebetween, and the glue is therefore confined within the space defined between these glue dams 44. The glue dams 44 are designed to be movable toward and away from each other by respective drive means 45, so that they may be axially shifted in accordance with any change in the width of the corrugated medium 16. Since these drive means 45 as shown are of a symmetrical structure, description will be made only for the right drive means 45 in FIG. 3**.

To describe the same in detail, a bracket 46 is fixed upon the upper part of the glue dam 44 at a position adjacent to the weir 40, and a nut 48 is fixed upon this bracket 46. A horizontal support 51 is extended between a pair of frames 50 disposed respectively upon each side of the glue pan 34, and a threaded shaft 52 extending parallel to the applicator roll 30 is threadingly engaged with the nut 48 with one end thereof being rotatably supported within a support member 53 disposed at a suitable position upon the horizontal support 51, wherein the other end of the threaded shaft 52 is connected to the power shaft of a motor 54 mounted upon the frame 50. Accordingly, the glue dam 44 can be moved along an axis disposed parallel to the axis of the applicator roll 30 under the cooperation of the threaded shaft 52 and the nut 48 by rotating the motor 54 in forward or reverse modes.

A location detector 64 is connected to the threaded shaft 52 for controlling the motor 54 based upon the detection data thereof.

At a position below the applicator roll 30 upon the glue dam 44, there is disposed a first regulating plate 56 having an arcuate contact surface **56*a* formed after in accordance with the lower circumferential portion of the applicator roll 30, plate 56 being mounted upon a bracket 66. The contact surface 56*a* of the first regulating plate 56 is designed to be brought into tight contact with the circumference of the applicator roll 30 and to be slidable upon the circumference of the roll 30 in accordance with the shifting of the glue dam 44. The first regulating plate 56 therefore functions to prevent axial spreading of the glue scraped off or removed from applicator roll 30 by means of the doctor roll 32 and which flows along the circumference of the applicator roll 30**.

At a position below the contact zone of the applicator roll 30 with the doctor roll 32, a second regulating plate 58 of the glue dam 44 and having a substantially triangular configuration as shown in FIG. 2 is disposed through means of a bracket 68. The second regulating plate 58 functions to prevent axial spreading of the glue staying within the contact zone defined between the two rolls 30 and 32.

To describe the same in detail, the contact surface **58*a* of the second regulating plate 58 facing the doctor roll 32 has an arcuate curve formed in accordance with the circumference of the doctor roll 32 and is abutted against the roll 32 so as to be slidable along its circumference; whereas the contact surface 58***b* of the second regulating plate 58 facing the applicator roll 30 has an arcuate curve formed in accordance with the circumference of the applicator roll 30 and is abutted against the roll 30 so as to be slidable along its circumference. Accordingly, a triangular space 70 defined between the two opposing rolls 30 and 32 upon the lower side of the contact zone defined between the two rolls 30 and 32 is closed by means of the second regulating plate 58 as shown in FIG. 2. Furthermore, the outer end of the contact surface 58*b* of the second regulating plate 58 and the inner end of the first regulating plate 56 are positioned with a very small clearance defined therebetween, so that the glue may not leak out from such clearance.

Incidentally, it is not an essential constituent of this invention to design the first regulating plate 56 and the second regulating plate 58 as separate members, and these two regulating plates can be designed as a single member.

Figure 4:
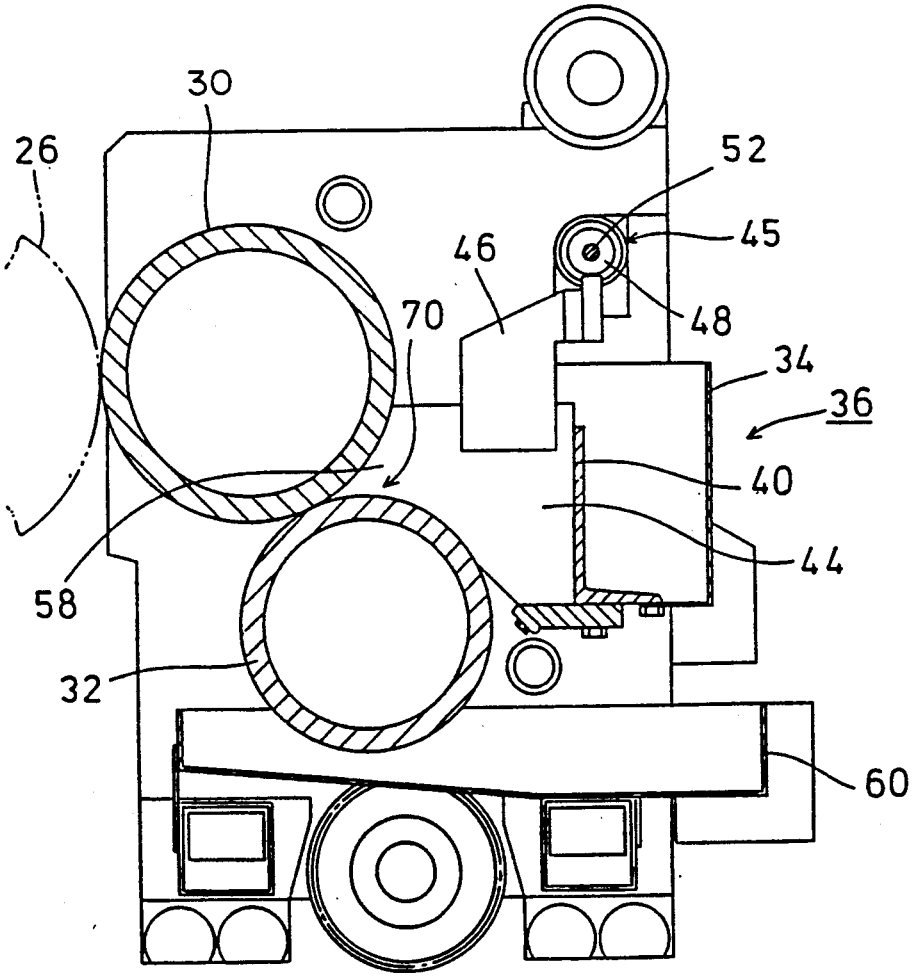
FIG. 4 is a cross-sectional side view of the gluing unit according to another preferred embodiment of this invention.

Now, FIG. 4 shows another embodiment of this invention, and the gluing unit of this embodiment is utilized in conjunction with the second fluted roll unit 28 of the single facer 10 as shown in FIG. 6. To describe the same more in detail, the applicator roll 30 and the doctor roll 32 are disposed in a substantially vertical relationship with respect to each other with the axis of the applicator roll 30 being shifted through means of a predetermined distance toward the inner roll 26, wherein these two rolls 30 and 32 are brought into parallel contact with each other over the entire length thereof so as to define a triangular space 70 therebetween. The glue fed to this triangular space 70 is designed to be leveled between the two rolls 30 and 32 so as to form a glue film upon the applicator roll 30.

A glue pan 34 is disposed beside the two rolls 30 and 32 so as to surround the triangular space 70, and a pair of glue dams 44 are disposed within this glue pan 34, only one is seen in FIG. 4, so that they can move toward and away from each other by means of a pair of drive means 45 (only one drive means 45 is shown in FIG. 4). The glue retained between the glue dams 44 is fed to the triangular space 70.

A regulating section 58 is formed upon the end of each glue dam 44 so as to face the two rolls 30 and 32 and be abutted against the two opposing circumferences of these two rolls 30 and 32 within the vicinity of the contact zone thereof so as to close the triangular space 70. Accordingly, the glue disposed within the vicinity of the contact zone of the two rolls 30 and 32 is prevented from spreading axially along the applicator roll 30 by means of the regulating section 58. Incidentally, the reference number 60 designates a tray within which the glue dropping from the glue pan 34 is collected.

Figure 5:
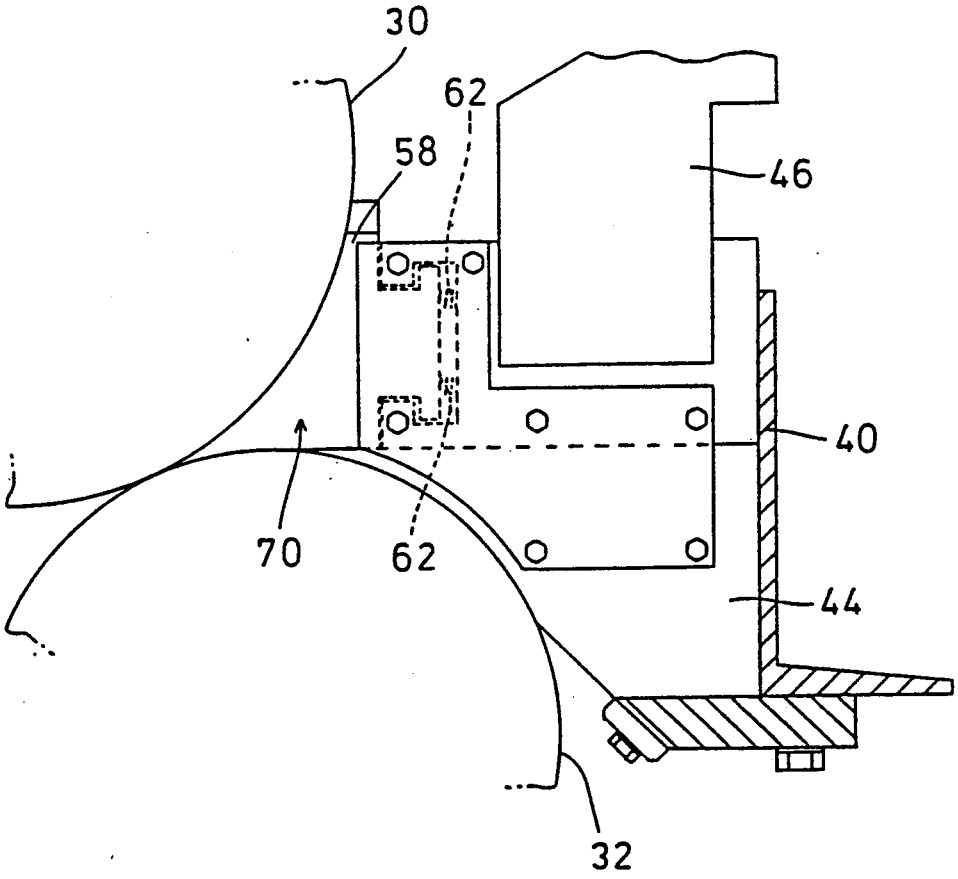
FIG. 5 shows, in cross section, the major section of the gluing unit according to still another preferred embodiment of this invention.

FIG. 5 shows a variation of the embodiment shown in FIG. 4, wherein a movable member 58 which is retractable relative to the glue dam 44 is disposed upon the glue dam 44 at a position facing the applicator roll 30. The movable member 58 is constantly biased by means of a compression spring 62 so as to be in resilient pressure contact with the applicator roll 30. Accordingly, if the surface of the movable member 58 to be brought into contact with the applicator roll 30 should be worn, the movable member 58 can constantly be pressed against the applicator roll 30, so that axial leakage of the glue beyond the movable member 58 can be prevented.

In the gluing unit according to any one of the constituted embodiments as have been disposed, when the glue disposed within the glue pan 34 is taken up by means of the applicator roll 30, the surplus glue is scraped off or removed from the contact zone by means of the doctor roll 32, whereby a uniform glue film is formed upon the applicator roll 30. The thus formed glue film is transferred to the crests of the corrugated medium 16 having a corrugation formed by means of the first fluting roll unit 22, as shown in FIG. 6.

In the above process, when the applicator roll 30 is performing a high-speed rotation, the surplus glue scraped off or removed from the applicator roll by means of the doctor roll 32 does not drop into the glue pan 34 but remains within the triangular space 70 adjacent to the contact zone of the two rolls 30 and 32. While the glue tends to spread axially in accordance with the rotation of the applicator roll 30, the second regulating plates 58 disposed upon the glue dams 44, respectively, are in contact with both of the two rolls 30 and 32 so as to close the triangular space 70 and prevent spreading of the glue therebeyond.

Accordingly, spreading of the surplus glue beyond the glue transferring area of the applicator roll 30, from where the glue is transferred to the corrugated medium 16, can effectively be prevented. Furthermore, the first regulating plates 56 disposed so as to abut against the lower portion of the applicator roll 30 also prevent axial spreading of the glue flowing down toward such portion of the applicator roll 30.

In the embodiment shown in FIG. 4, the glue dams 44, which function to define a space together with the applicator roll 30 and the doctor roll 32 for confining the glue within the contact zone defined between these two rolls, each have the regulating section 58 formed at one end and which is brought into contact with both of the two rolls 30 and 32 so as to close the triangular space 70. Accordingly, the glue never spreads axially beyond the glue dams 44, and the glue is applied to the applicator roll 30 only along a zone having a width corresponding to that of the corrugated medium 16.

Obviously, many modifications and variations of the present invention are possible in light of the above teachings. It is therefore to be understood that within the scope of the appended claims, the present invention may be practiced otherwise than as specifically described herein.

What is claimed is:

1. Liquid transferring apparatus, comprising:

a tank for containing a liquid;

an applicator roll partially immersed within said liquid disposed within said tank for transferring said liquid from said tank to an object to be coated with said liquid;

a doctor roll disposed in peripheral contact with said applicator roll for removing excess liquid disposed upon said applicator roll prior to transfer of said liquid from said applicator roll to said object to be coated;

a pair of axially spaced dam plates having arcuately shaped portions for engaging peripheral portions of said applicator and doctor rolls within the vicinity of a triangularly configured region defined between said applicator and doctor rolls at the location at which said doctor and applicator rolls are disposed in peripheral contact with each other;

support means disposed within the vicinity of said tank; and motor drive means mounted upon said support means and operatively connected to said dam plates for adjustably moving said pair of axially spaced dam plates toward and away from each other along an axis disposed parallel to axes of said doctor and applicator rolls.

2. Apparatus as set forth in claim 1, further comprising:

scraper means disposed in peripheral contact with said doctor roll for removing liquid disposed upon said doctor roll.

3. Apparatus as set forth in claim 1, further comprising:

bracket means fixedly mounted upon said dam plates;

nut means fixedly connected to said bracket means; and threaded shaft means operatively engaged with said nut means and said motor drive means for transmitting motor drive power from said motor drive means to said nut means and said bracket means so as to move said nut means, said bracket means, and said dam plates in accordance with rotary drive of said motor drive means.

4. Apparatus as set forth in claim 1, further comprising:

detecting means for detecting the position of said dam plates and for controlling the operation of said motor drive means in response thereto.

5. Apparatus as set forth in claim 1, further comprising:

a second pair of axially spaced dam plates having arcuately shaped portions for engaging peripheral portions of said applicator roll.

6. Apparatus as set forth in claim 1, further comprising:

spring biasing means for mounting said dam plates relative to said applicator and doctor rolls so as to bias said dam plates toward said applicator and doctor rolls and into contact with said peripheral portions of said applicator and doctor rolls.

7. Apparatus as set forth in claim 1, wherein:

said axes of said applicator and doctor rolls are disposed within a horizontal plane.

8. Apparatus as set forth in claim 1, wherein:

said axes of said applicator and doctor rolls are disposed within a substantially vertical plane.

* * * * *